US005137552A

United States Patent [19]

Sasaki

[11] Patent Number: 5,137,552

[45] Date of Patent: Aug. 11, 1992

[54] DUST COLLECTING CELL

[75] Inventor: Toshihiko Sasaki, Kanagawa, Japan

[73] Assignee: Yamatake-Honeywell Co., Ltd., Tokyo, Japan

[21] Appl. No.: 630,513

[22] Filed: Dec. 20, 1990

[30] Foreign Application Priority Data

Mar. 6, 1990 [JP] Japan ..... 2-22319[U]

[51] Int. Cl.[5] ..... B03C 3/08

[52] U.S. Cl. ..... 55/139; 55/143; 55/145

[58] Field of Search ..... 55/139, 143, 145, 146, 55/101

[56] References Cited

U.S. PATENT DOCUMENTS

| | | | |
|---|---|---|---|
| 2,798,572 | 7/1957 | Fields | 55/143 X |
| 4,163,650 | 8/1979 | Watson et al. | 55/139 X |
| 4,259,093 | 3/1981 | Vlastos et al. | 55/145 X |
| 4,274,843 | 6/1981 | Sone et al. | 55/139 |
| 4,313,741 | 2/1982 | Masuda et al. | 55/145 X |
| 4,516,991 | 5/1985 | Kawashima | 55/139 X |
| 4,569,684 | 2/1986 | Ibbott | 55/145 X |
| 4,673,416 | 6/1987 | Sakakibara et al. | 55/139 X |

*Primary Examiner*—Richard L. Chiesa
*Attorney, Agent, or Firm*—Whitham & Marhoefer

[57] ABSTRACT

A dust collecting cell for a dust collector has a plurality of first electrode plates, a plurality of second electrode plates each disposed between the adjoining two of the first electrode plates in a parallel and spaced apart relation thereto, and a block defining a plurality of resistors having a high value of resistance which are connected between the first or second electrode plates and a source of high voltage supply. Even if a dielectric breakdown may occur between any two adjoining electrode plates, the resistors ensure that the discharge take place only as a local phenomenon, and that the cell make only a low noise accompanying the discharge.

6 Claims, 2 Drawing Sheets

DUST COLLECTING CELL

BACKGROUND OF THE INVENTION

1. Field of the Invention

This invention relates to a dust collecting cell used for the dust collector in an electronic air cleaner, or like device.

2. Description of the Prior Art

There is known a dust collecting cell constructed as shown in FIG. 1. The cell comprises a plurality of positive electrode plates 1 and a plurality of negative electrode plates 2 lying alternately with the positive electrode plates 1 in a parallel and appropriately spaced apart relation thereto. Each electrode plate 1 or 2 is, for example, a thin sheet of aluminum. The cell also includes a high voltage power source 3 adapted to supply a positive charge of high voltage to the positive electrode plates 1 and a negative charge of high voltage to the negative electrode plates 2. If high voltage is applied to the positive and negative electrode plates 1 and 2, fine particles of dust passing between the adjoining electrode plates are electrostatically attracted thereto and are thereby collected.

In the cell as shown in FIG. 1, however, the positive and negative electrode plates 1 and 2 are both of the same potential and are connected in parallel to each other. Therefore, an electric charge defined as $Q=C\cdot V$ is accumulated between the electrode plates, as is the case with a capacitor using air as a dielectric. If a coarse particle of waste enters the cell between any pair of adjoining electrode plates 1 and 2, it causes a dielectric breakdown resulting not only in the discharge of the electricity which has been accumulated therebetween, but also in the discharge of the electricity accumulated between any other pair of electrode plates which occurs through that part of the cell in which the dielectric breakdown has occurred. The discharge makes a very large noise.

Another known cell construction is shown in FIG. 2. It includes an insulating resin 10 covering each electrode of one polarity (in FIG. 2, each positive electrode plate 1) to realize a higher withstand voltage to thereby prevent any dielectric breakdown. In this form of construction, however, the reliability of the insulating resin 10 is critical. Its reliability is easily lowered or lost if it has any pinhole, or is flawed during the fabrication of the cell or during its use, as when it is cleansed, or if it is deteriorated by a strongly alkaline solution used for cleansing the cell, by the ozone which is generated upon application of high voltage, or by the ultraviolet radiation which is applied to the cell to kill the bacteria which have propagated in the contaminated portions of the cell.

SUMMARY OF THE INVENTION

Under these circumstances, it is an object of this invention to provide a dust collecting cell in which the magnitude of any electrical discharge and the resulting noise can be greatly reduced.

This object is essentially attained by a cell which comprises a plurality of first electrode plates, a plurality of second electrode plates each disposed between the adjoining two of the first electrode plates in a parallel and spaced apart relation thereto, a source of high voltage power supply, and a body of high electrical resistance connected between the first or second electrode plates and the source of high voltage power supply.

The body of high electrical resistance is connected between the power source and the positive or negative electrode plates, so that high voltage may be applied to the electrode plates through that body. If the cell of this invention is used, therefore, it is possible to restrict any dielectric breakdown occurring between the electrode plates to only a local phenomenon and thereby reduce the resulting noise to a level which is several tens of times lower than what has hitherto been unavoidable.

The cell of this invention is free from any problem of the nature which has been encountered by the conventional cell having electrode plates covered with a defective or deteriorated insulating resin.

The body of high electrical resistance is preferably formed as a single block of an electrically conductive resin. This enables the realization of a strong cell at a low cost.

DETAILED DESCRIPTION OF THE PREFERRED EMBODIMENTS

Figure 1:
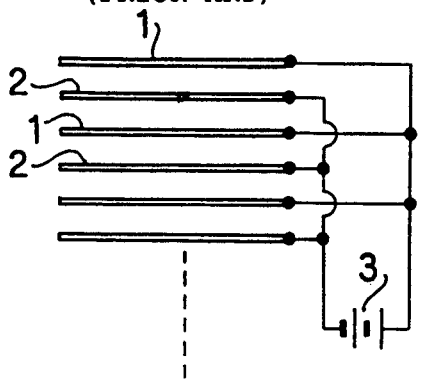
FIG. 1 (PRIOR ART)
FIG. 1 is a schematic view of a dust collecting cell known in the art.
Figure 2:
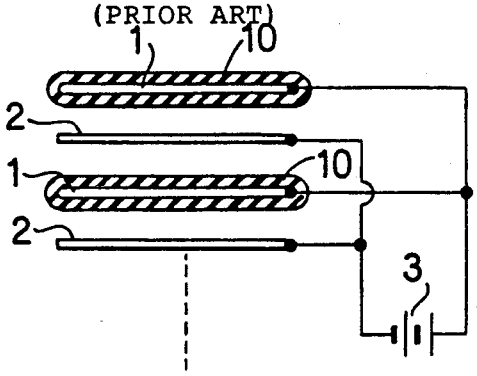
FIG. 2 (PRIOR ART)
FIG. 2 is a schematic view of another known dust collecting cell.

The invention will now be described more specifically with reference to the accompanying drawings showing a few preferred embodiments thereof. The drawings include FIG. 3 which illustrates the basic concept of this invention. Like numerals are used to show like parts throughout all of the drawing figures, so that no repeated description may be necessary of any similar part that has already been described with reference to FIGS. 1 and 2.

Figure 3:
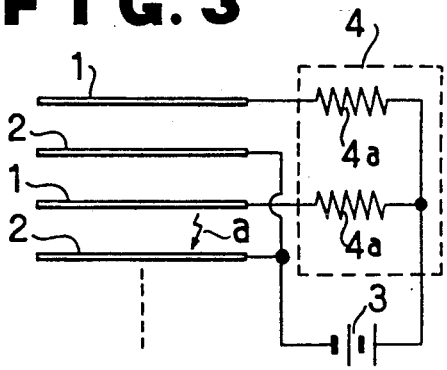
FIG. 3 is a schematic view showing the basic concept of this invention.

Referring more particularly to FIG. 3, the cell of this invention is basically featured by a high resistor body or block 4 defining a plurality of high resistors **4*a* each having one end connected to a positive electrode plate 1, while the other end thereof is connected to the positive pole of a source 3 of high voltage power supply, and having a high value of electrical resistance. If a dielectric breakdown occurs, for example, at a point shown as 'a' between a pair of adjoining positive and negative electrode plates 1 and 2, it is only the electricity which has been accumulated between that pair of electrode plates that is discharged, and the high resistors 4*a* prevent the electric charge between any other pair of electrode plates from passing to the point 'a'. The discharge is limited to the point 'a', takes place only on a small scale, and therefore, makes only a low noise. The high resistors 4*a* do not exert any adverse effect on the dust collecting performance of the cell, since it is carried out by the electrostatic force produced by the high voltage supplied from the power source 3**, and does not call for the passage of any electric current.

Figure 4:
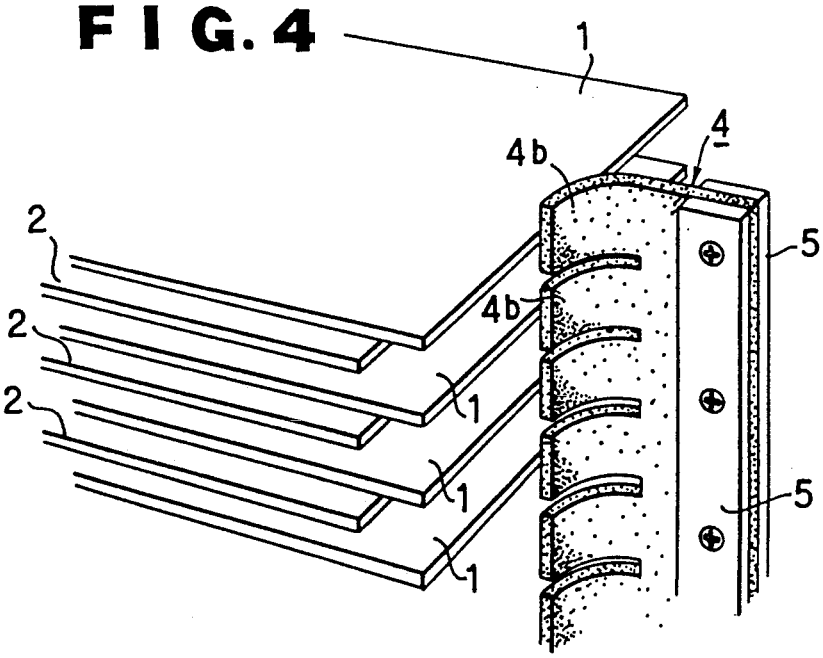
FIG. 4 is a fragmentary perspective view of a dust collecting cell embodying this invention.
Figure 5:
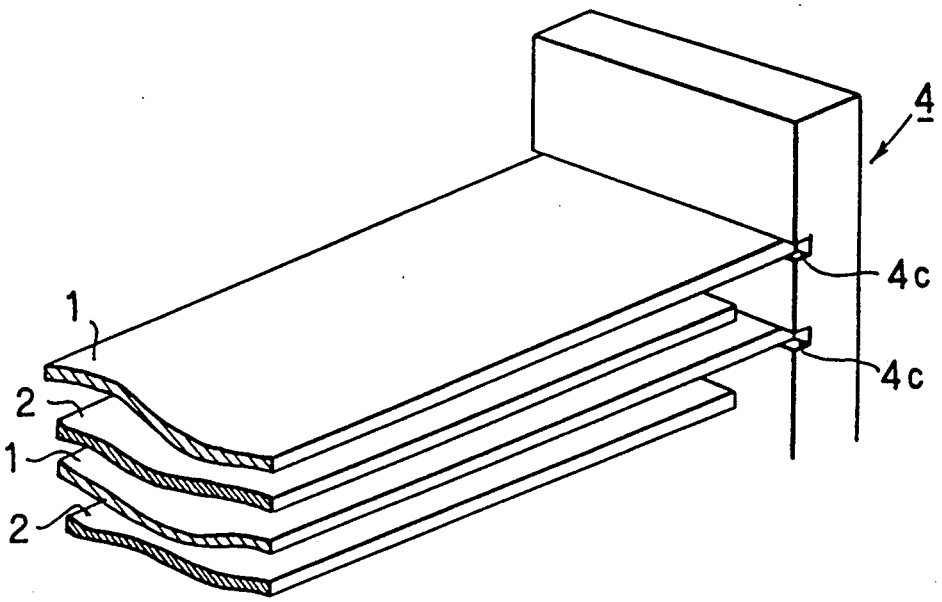
FIG. 5 is a fragmentary perspective view of a dust collecting cell according to another embodiment of this invention.
Figure 6:
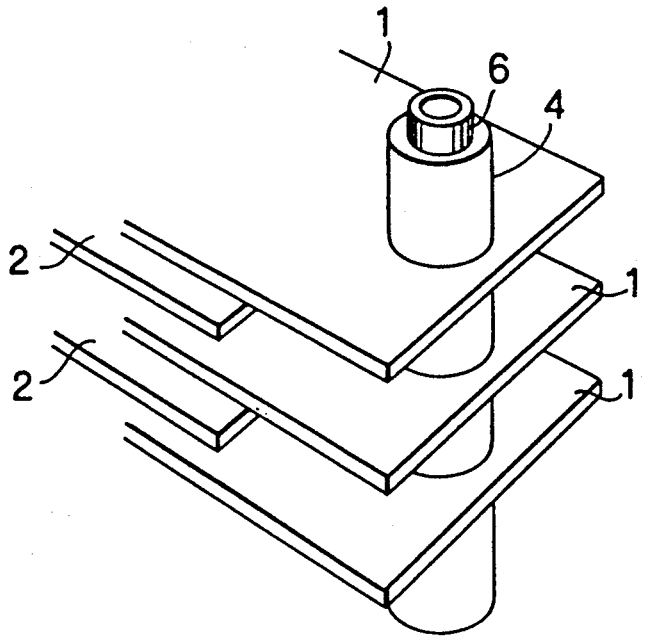
FIG. 6 is a fragmentary perspective view of a dust collecting cell according to still another embodiment of this invention.

Attention is now directed to FIGS. 4 to 6 showing by way of example three specific forms of construction embodying the concept of the invention which has been described with reference to FIG. 3. In all of the three forms, the high resistor block 4 is formed from an electrically conductive resin having a resistivity of $10^5$ to $10^{10}$ ohms.

Referring to the first form of construction as shown in FIG. 4, the high resistor block 4 has a plurality of contact portions 4*b* abutting resiliently upon the edges of the positive electrode plates 1, respectively. The edge of the block 4 which is remote from the contact portions 4*b* is held between a pair of metal strips 5 which are electrically connected to the positive pole of the power source 3 not shown.

According to the second form of construction as shown in FIG. 5, the high resistor block 4 has a plurality of grooves 4*c* formed in its surface facing the electrode plates and each positive electrode plate 1 has an edge fitted in one of the grooves 4*c*.

Referring finally to the third form of construction as shown in FIG. 6, the high resistor block 4 is in the form of a hollow cylinder extending through the positive electrode plates 1 adjacent to one edge thereof and is thereby connected electrically between the electrode plates 1 and the power source 3 not shown. A metal pipe (or rod) 6 is fitted in the bore of the cylindrical block 4 and is connected to the positive pole of the power source 3.

Although the high resistor block 4 has been described and shown as being connected to the positive electrode plates 1, it is, of course, possible to connect it to the negative electrode plates 2 and achieve the same results as have hereinabove been described.

What is claimed is:

1. A dust collecting cell comprising:

a plurality of first electrode plates;

a plurality of second electrode plates each disposed between an adjoining two of said first electrode plates, said plurality of first electrode plates and said plurality of second electrode plates arranged in a parallel and spaced apart relation;

a source of high voltage power supply;

means having a high ohmic resistance connecting an output of one polarity of said high voltage power supply to said first plurality of electrode plates; and means coupling an output of said high voltage power supply of opposite polarity to said one polarity to said second plurality of electrode plates.

2. A dust collecting cell as set forth in claim 1, wherein said means having a high ohmic resistance is defined by a single block having a high ohmic resistance.

3. A dust collecting cell as set forth in claim 2, wherein said block is formed from a electrically conductive resin having a resistivity of $10^5$ to $10^{10}$ ohms.

4. A dust collecting cell as set forth in claim 3, wherein said block has a plurality of contact portions each abutting resiliently upon one of said first or second electrode plates.

5. A dust collecting cell as set forth in claim 3, wherein said block has a plurality of grooves and one edge of each of said first or second electrode plates is fitted in one of said grooves.

6. A dust collecting cell as set forth in claim 3, wherein said block is in the form of a hollow cylinder extending through said first or second electrode plates adjacent to one edge thereof and is thereby connected electrically to said electrode plates.

* * * * *